33-234 SR
5/23/78 OR 4,090,305

United States Patent [19]
Cassidy

[11] 4,090,305
[45] May 23, 1978

[54] PRECISION RIFLE SIGHT ADJUSTER

[76] Inventor: James Lawrence Cassidy, 66 Prospect St., Turners Falls, Mass. 01376

[21] Appl. No.: 732,302

[22] Filed: Oct. 14, 1976

Related U.S. Application Data

[63] Continuation-in-part of Ser. No. 624,656, Oct. 22, 1975, abandoned.

[51] Int. Cl.[2] ..... F41G 1/54
[52] U.S. Cl. ..... 33/234; 33/391
[58] Field of Search ..... 33/234, 391

[56] References Cited

U.S. PATENT DOCUMENTS

| | | | |
|---|---|---|---|
| 1,295,075 | 2/1919 | Sheppard | 33/234 |
| 3,112,567 | 12/1963 | Flanagan | 33/234 |
| 3,279,084 | 10/1966 | Bohlen et al. | 33/391 X |
| 3,908,282 | 9/1975 | Steffan | 33/234 |

*Primary Examiner*—William D. Martin, Jr.
*Attorney, Agent, or Firm*—Ross, Ross & Flavin

[57] ABSTRACT

The instrument includes a shaft or tube which is inserted into the end of a gun barrel and includes at least one balanced module having an index pointer disposed a few inches in front of the free end of the barrel and extending vertically upwardly into the field of vision of the line of sighting. The index pointers are centered directly over the center line of the gun bore and mark its vertical plane. By sighting through the scope of the gun verification of the vertical collimation of the line of sighting can be made since one can readily see if the reticle cross hairs coincide precisely with the index pointers or not. If not, adjustments can be made to correct the line of sighting.

4 Claims, 6 Drawing Figures

PRECISION RIFLE SIGHT ADJUSTER

This is a countinuation-in-part of my application Ser. No. 624,656 filed Oct. 22, 1975, now abandoned.

Accuracy in target shooting and hunting requires that the line of sighting be in the same vertical plane with and above the center line of the gun bore. The factory setting is often disturbed by rough handling in transportation and in the field. The usual sighting-in procedure does not correct for such displacement but rather exaggerates error for all other distances than that of the sighting-in target. The instrument of this invention actually makes the vertical plane containing the center line of the gun bore visible in the field of vision of the line of sighting so that verification and correction if needed can be made in the field.

Perfection in aiming a rifle depends largely upon the line of sighting being wholly within the vertical plane directly above the center line of the gun bore. The purpose of this invention is to provide a means for the verification of the vertical collimation of the line of sighting by showing exactly where the vertical plane is so that the line of sighting can be readily compared and adjusted to conform with the vertical plane as an adjunct to sighting-in in the field.

In my application Ser. No. 624,656, now abandoned embodying sighting instruments which serve to correct errors due to parallax and to rifle tilt, it was assumed that the position of the sighting instrument upon the gun barrel retains its precision under all conditions. Actually this is rarely the case as the instrument is of a delicate nature and prone to slight displacement by rough handling in transportation, etc. This invention proposes to correct that oversight by providing a means for verifying the relationship of the line of sighting to the vertical plane containing the center line of the gun bore. It can be used with any gun or sight.

When used with sighting devices not having parallax and tilt correcting features, a pair of balanced modules must be used, one placed a few inches apart from the other. This is for the purpose of eliminating parallax in viewing through the vertical plane with only a single reticle.

The adjuster itself is quite simple, consisting of a minimum of parts. A metal rod a few inches long is secured for part of its length within the gun barrel in such a way that its center line corresponds with that of the gun bore. Near the projecting end of the rod one or a pair of annular circumferential grooves is ground to serve as bearing surfaces for one or a pair of balanced modules, each of which carries an index pointer on one end and a suitable weight on the other end with a knife edge type of balance suspension therebetween. The balanced modules can readily be placed on the rod with their knife edges bearing in the grooves of the rod. A special lens is provided for fitting over the scope objective lens to bring the index pointer or pointers into focus through the scope.

Since sighting scopes are delicate instruments and prone to get out of adjustment, the adjuster hereof should be fitted to the rifle before the usual sighting-in shots are fired. By simply sighting at the index pointer one can see if the reticles coincide properly and adjust them if they do not. Then, removing the adjuster, the gun is fired in the usual manner, both to warm it up and to bring out any other impact deviations.

The adjuster, generally indicated by 10, is fitted to the bore 12 of a rifle barrel 14 and includes a shaft or tube 16 preferably formed from hardened steel and approximately one foot or more in length.

Figure 1:
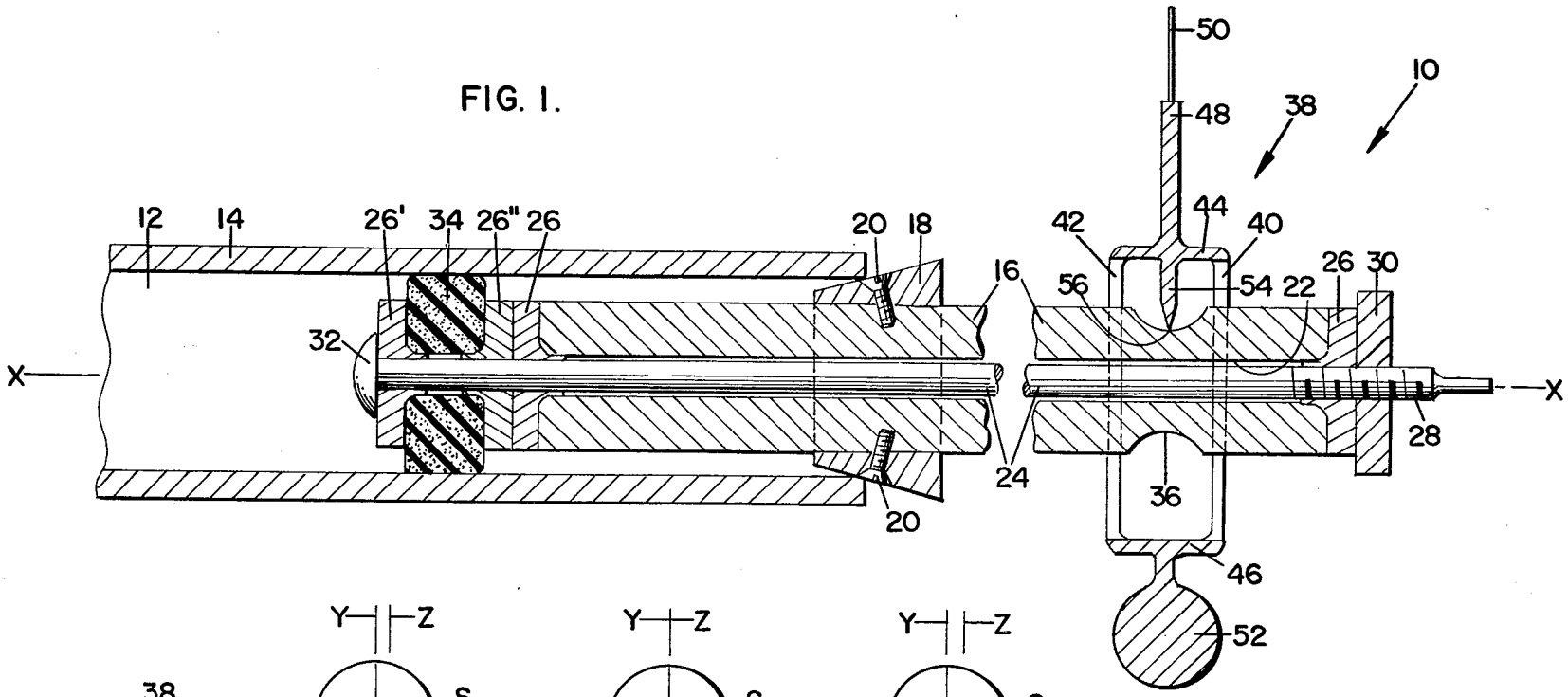
FIG. 1 is a broken cross-sectional view of the adjuster fitted to the bore of a rifle.

A cone shaped plug 18 is sleeved on shaft 16 and is fixed thereto as by rivets 20 or the like, the plug serving to center the inner end of shaft 16 in bore 12 as shown in FIG. 1.

Shaft 16 is provided with a through-bore 22 having a central rod 24 disposed therein and extending outwardly from opposite ends thereof, the rod being supported in through bore 22 by centering washers 26 disposed at each end of shaft 16 so as to be aligned with the longitudinal axis X of the bore of the gun barrel.

The outer free end of rod 24 is threaded as at 28 and has a knurled nut 30 threaded thereon, and the inner end of the rod is provided with a head 32.

Head 32 bears against a centering washer 26' sleeved on rod 24 and embracing one side face of a compression washer 34 of cork or other compressible material, the other face of which is embraced by a centering washer 26" also sleeved on rod 24 and disposed in back-to-back relation with the inner centering washer 26.

Compression washer 34 is of appropriate size to fit snugly in the bore 12 of rifle barrel 14.

Rotation of knurled nut 30 will squeeze compression washter 34 thereby slightly altering its diameter so as to better fit minor variations of gun bore and rifling, not shown.

An annular circumferential groove 36 is provided adjacent the outer free end of shaft 16, the groove serving as a bearing surface for a balanced module, generally indicated by 38.

Balanced module 38 comprises a pair of spaced upright and parallel rings 40 and 42 interconnected at their upper and lower ends by webs 44 and 46 respectively extending transversely therebetween.

A centrally-disposed index pointer support 48 extends upwardly from upper web 44 and has an index pointer 50 in the form of a slim spring steel wire extending vertically upwardly therefrom.

A pendulum-type counterbalancing weight 52 depends centrally from lower web 46.

A bearing member 54 depends centrally from upper web 44, the bearing member having a lower knife edge 56 of V-shape adapted to ride in the groove 36 of shaft 16. The lower knife edge 56 may also be of curved configuration in lieu of the V-shape as shown.

Balance module 38 has an index pointer on its upper end and a counterbalancing weight on its other end with a means of securing a delicate but rugged balance on a knife edge bearing member therebetween.

A close-up focusing auxiliary lens, not shown, of commercially available type will be included for fitting over the scope objective lens to bring the index pointer into clear focus through the scope.

Figure 6:
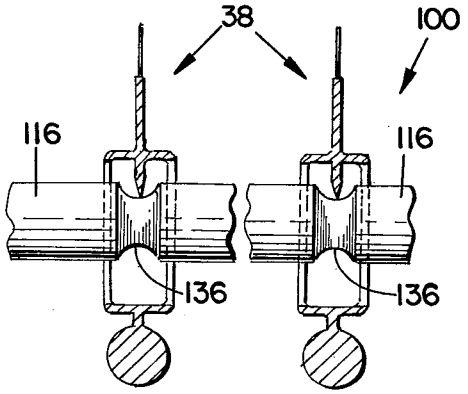
FIG. 6 is a broken cross-sectional view of a modified form of the invention.

In the modified form of the invention shown in FIG. 6, an adjustment member 100 includes a shaft 116 having a pair of grooves 136 spaced a few inches apart and adapted to receive a pair of balanced modules 38 as shown.

This form is for use with ordinary scopes and open sights where it is necessary to further define the vertical plane above the bore center line by use of two index pointers suitably separated.

The two index pointers completely define the vertical plane above the bore center line for use with scopes not having parallax eliminating reticles.

Figure 5:
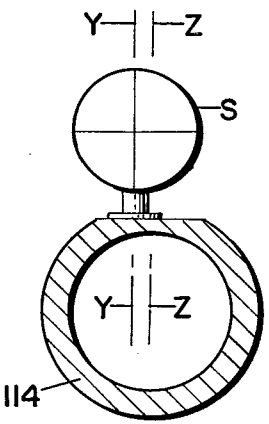
FIGS. 3, 4 and 5 are elevational part sectional views showing several vertical sight alignment conditions.
Figure 4:
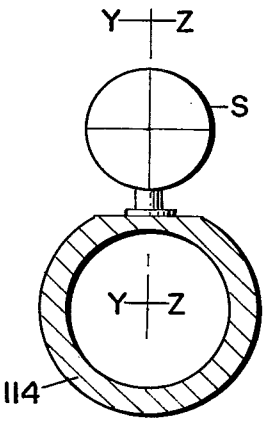
Figure 3:
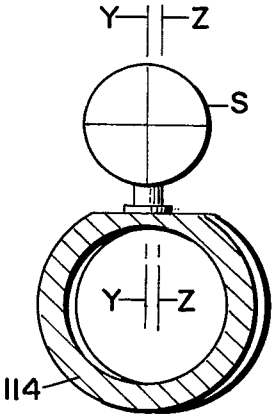
Figure 2:
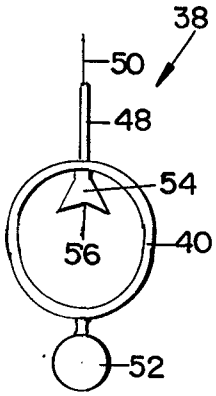
FIG. 2 is an elevational view of one of the balanced modules of the adjuster.

FIGS. 3 through 5 show several vertical sight alignment conditions of a scope S relative to a gun barrel 114.

In FIG. 3, the scope S is askew and its axis Y is not in vertical alignment with the axis Z of gun barrel 114.

In FIG. 4, the axis Y of the scope S and the axis Z of the gun barrel 114 are in perfect vertical alignment.

In FIG. 5, the scope S is not centered relative to the gun barrel 114 wherefore the axes Y and Z are not vertically aligned.

Use of the adjuster of the invention will permit correction of the conditions of FIGS. 3 and 5 to produce the desired condition of FIG. 4.

I claim:

1. In combination with a rifle having a sight, an instrument for the precise adjustment of the vertical collimation of the line of sighting comprising, a hollow shaft to be inserted part way into the bore of a rifle barrel at the muzzle end, accurately centered therein and extending forwardly therefrom, at least one counterbalance module supported on the shaft and having an index pointer extending vertically upwardly into the field of vision of the line of sighting, and means for centering the shaft within the rifle barrel comprising a rod extending axially through the length of the hollow shaft having a head at one end and an external threaded portion at its opposite end, centering washers disposed at opposite ends of the rod for centering the rod within the hollow shaft, a flexible washer of resilient material mounted on the rod between certain of the centering washers and the end of the shaft within the rifle barrel, a knurled nut operable at the external threaded position of the rod for drawing the head of the rod against certain of the centering washers for squeezing the flexible washer and causing it to expand radially for gripping the internal rifled walls of the rifle barrel in such manner as to average out rifling and other irregularities, and perfectly center the innermost end of the shaft and rod relative to the rifle barrel, and a cone shaped collar on the shaft having its tapered lesser diameter end inserted into the rifle barrel for providing a second centering support point.

2. The combination according to claim 1, including ground and hardened fluted grooves cut circumferentially around the shaft for supporting the counterbalanced modules.

3. The combination according to claim 2, wherein the counter-balanced modules include a bearing member of a shaped knife-edge type receivable in the grooves for supporting the index pointer in such a manner as to cause it to remain in the vertical plane above the rifle barrel center-line even though the rifle barrel is not held perfectly level as in field work.

4. The combination according to claim 1, including a pair of counter-balanced modules spaced on the shaft for clearly indicating if any parallax is present.

* * * * *